US006963705B2

(12) United States Patent
Quinones

(10) Patent No.: US 6,963,705 B2
(45) Date of Patent: Nov. 8, 2005

(54) CONTROL SYSTEM FOR WIPING A CORONA WIRE IN A XEROGRAPHIC PRINTER

(75) Inventor: Jose I. Quinones, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/668,418

(22) Filed: Sep. 23, 2003

(65) Prior Publication Data

US 2005/0063727 A1 Mar. 24, 2005

(51) Int. Cl.[7] ..... G03G 15/02
(52) U.S. Cl. ..... 399/100; 399/170
(58) Field of Search ..... 399/100, 115, 170, 399/171, 172

(56) References Cited

U.S. PATENT DOCUMENTS

| | | | | |
|---|---|---|---|---|
| 4,864,363 | A * | 9/1989 | Shinada | 355/133 |
| 5,485,255 | A | 1/1996 | Reuschle et al. | |
| 6,449,447 | B1 | 9/2002 | Regelsberger et al. | 399/100 |
| 6,580,885 | B2 | 6/2003 | Walgrove, III et al. | 399/100 |

* cited by examiner

*Primary Examiner*—Hoang Ngo
(74) *Attorney, Agent, or Firm*—R. Hutter

(57) ABSTRACT

In a xerographic printing apparatus, a corotron having a wire is used to apply a charge to a photoreceptor. The wire is cleaned by a motorized shuttle which travels in two directions along the wires. The shuttle is controlled by detection of an increased current consumption associated with the motor.

11 Claims, 2 Drawing Sheets

CONTROL SYSTEM FOR WIPING A CORONA WIRE IN A XEROGRAPHIC PRINTER

TECHNICAL FIELD

The present disclosure relates to xerographic printing apparatus, and specifically to a mechanism for cleaning a charging device associated with the apparatus.

BACKGROUND

In the well-known process of electrostatographic or xerographic printing, an electrostatic latent image is formed on a charge-retentive imaging surface, and then developed with an application of toner particles. The toner particles adhere electrostatically to the suitably-charged portions of the imaging surface. The toner particles are then transferred, by the application of electric charge, to a print sheet, forming the desired image on the print sheet. An electric charge can also be used to separate or "detack" the print sheet from the imaging surface.

For the initial charging, transfer, or detack of an imaging surface, the most typical device for applying a predetermined charge to the imaging surface is a "corotron," of which there are any number of variants, such as the scorotron or dicorotron. Common to most types of corotron is a bare conductor, in proximity to the imaging surface, which is electrically biased and thereby supplies ions for charging the imaging surface. The conductor typically comprises one or more wires (often called a "corona wire") and/or a metal bar forming saw-teeth, the conductor extending parallel to the imaging surface and along a direction perpendicular to a direction of motion of the imaging surface. Other structures, such as a screen, conductive shield and/or nonconductive housing, are typically present in a charging device, and some of these may be electrically biased as well. The corotron will have different design parameters depending on whether it is being used for initial charging, transfer, or detack.

In a practical application of charging devices, dust and other debris may collect in or around the corotron. Clearly, the presence of such material will adversely affect the performance of the corotron, and may cause dangerous arcing conditions. Therefore periodic cleaning of the charging device is often desired, and many schemes exist in the prior art for cleaning the charging device, such as by wiping the bare conductor. In high-end printing machines, this wiping may be performed by a motorized wiper which travels along the corotron wire; this wiper may be moved by a pulley or lead screw.

The present disclosure relates to a mechanism, and control system therefor, which wipes a corotron wire or similar structure in a printing apparatus.

PRIOR ART

U.S. Pat. No. 4,864,363 discloses a wiping mechanism for cleaning a corona wire, which employs a lead screw.

U.S. Pat. No. 5,485,255 discloses a wiping mechanism for cleaning a corona wire as well as a scorotron screen, which employs a lead screw.

U.S. Pat. No. 6,449,447 discloses a control system for a wiping mechanism for cleaning a corona wire, in which the wiping process is initiated when arcing conditions are detected in the charge device.

U.S. Pat. No. 6,580,885 discloses a control system for a wiping mechanism for cleaning a corona wire, in which a change in travel direction for the wiper is caused by the interaction of the moving wiper with a mechanical reversing switch, indicated in the patent as 88.

SUMMARY

According to one aspect, there is provided a printing apparatus, comprising an imaging surface and a charging device for placing a charge on the imaging surface, the charging device including a corona member extending in an extension direction. A shuttle is movable along the extension direction, the shuttle including a cleaning member useful for cleaning the corona member. A motor moves the shuttle along the extension direction. Control means change a direction of the motor in response to detecting a power consumption of the motor within a predetermined range.

DETAILED DESCRIPTION

Figure 1:
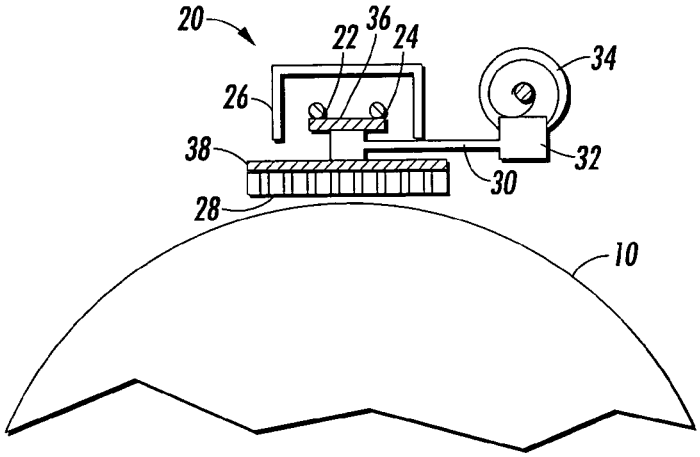
FIG. 1 PRIOR ART
FIG. 1 is an elevational view of a charging device associated with an imaging surface, as known in the prior art.

FIG. 1 is an elevational view of a charging device associated with an imaging surface, as known in the prior art. The imaging surface is shown as formed by a drum photoreceptor 10, although belt photoreceptors and other charge receptors are common as well. Disposed near the photoreceptor 10 is a charge device generally indicated as 20, which, depending on a larger context, may be for initial charging, transfer, or detack in a printing process. As mentioned above, charge devices, such as corotrons, scorotrons, dicorotrons, etc., have many design variants, but typically include one or more wires such as 22 or 24, a conductive shield and/or nonconductive housing such as 26, as well as a screen 28; each of these elements may be biased as required for a particular purpose. It is also known to provide a "pin corotron," which includes a set of pins or saw-teeth in lieu of a wire; herein, such wires, screens, pin sets, etc. can be generally called an "corona member," even if it is not biased in a particular application. As shown, wires 22 and 24 extend parallel to the imaging surface formed by photoreceptor 10, and perpendicular to a direction of rotation or motion of photoreceptor 10.

Figure 2:
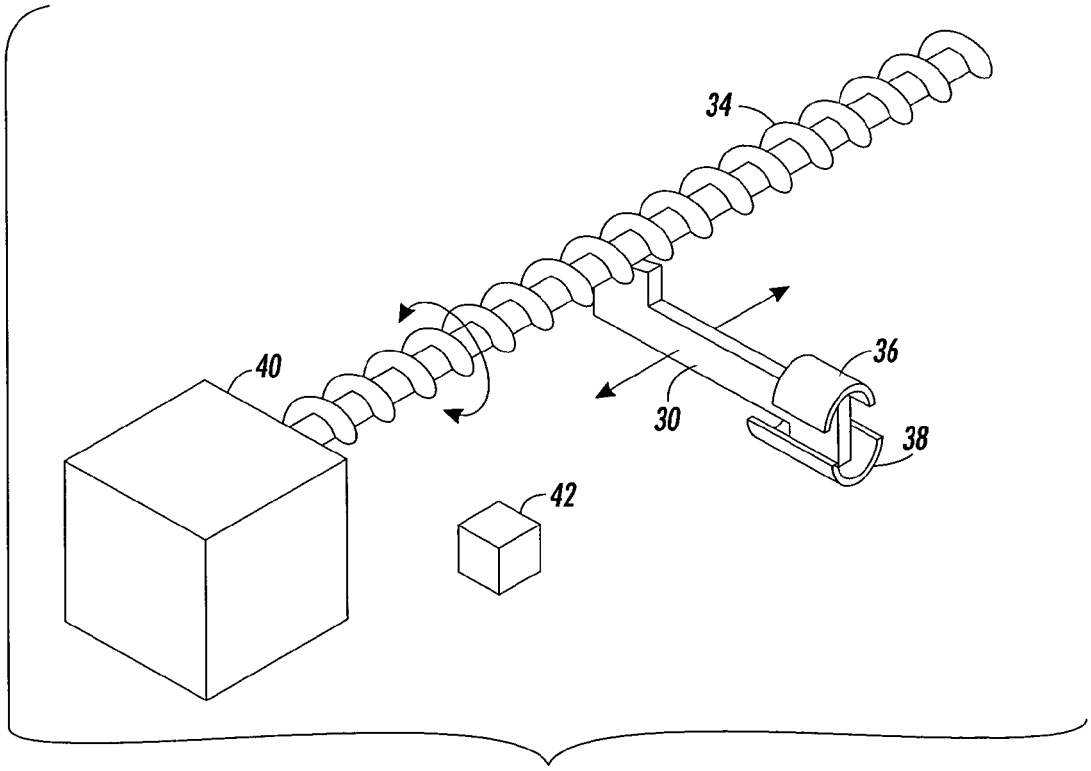
FIG. 2 PRIOR ART
FIG. 2 is a perspective view showing, in isolation, essential parts of a wiping mechanism for a charging device, as known in the prior art.

When it is desired to clean wires 22, 24, or screen 28, there is provided what is here generally called a "shuttle" 30. With further reference to FIG. 2, shuttle 30 is a piece which includes a tooth 32 which interacts with the windings of a lead screw 34; shuttle 30 further includes a wiper 36 for cleaning wire 22 and 24 and wiper 38 which cleans screen 38. Various configurations and materials for such wipers 36 and 38 are known in the prior art.

As can be seen in FIG. 2, shuttle 30 interacts with lead screw 34 so that, when lead screw 34 is rotated in a particular direction, the shuttle 30 travels along the lead screw, and thus moves along wires 22 and 24 and screen 28, whereby the wipers such as 36 and 38 can wipe or clean the wires 22 and 24 and screen 28. The lead screw is here rotated by a motor 40, which can rotate the lead screw in either direction. (In a practical embodiment, there may also be any number of guide rails or other surfaces, not shown, to facilitate proper motion of the shuttle 30.) Although the present embodiment includes a lead screw, other mechanisms for moving the shuttle 30 along the wires 22, 24 can be used, such as a linear motor, or other mechanisms for converting the rotational motion of a motor such as 40 to linear motion, such mechanisms including pulleys, belts, racks, etc.

In the operation of a shuttle 30 for cleaning a charging device, the shuttle 30 must travel the entire effective length of wires 22, 24 or similar structures, which is to say the shuttle 30 must travel a predetermined effective length of lead screw 34; in a practical embodiment, the shuttle 30 must travel the length of lead screw 34 from near motor 40 to the end of lead screw 34, and back (or vice-versa). Thus, the shuttle 30 must move in two directions, which means that motor 40 must rotate in two different directions to move the shuttle 30 away and back to the motor 40.

Figure 3:
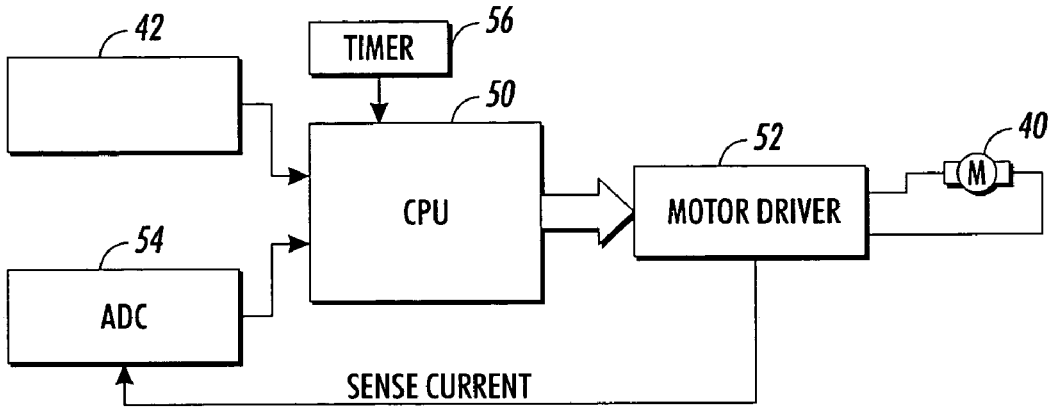
FIG. 3 is a simple schematic diagram showing a control system for a wiping mechanism.

FIG. 3 is a simple schematic diagram showing a control system for a wiping mechanism such as shown in FIG. 2. As can be seen, motor 40 is controlled by a motor driver 52, which in turn is controlled by a CPU 50. The CPU 50 may be operative of a larger system controlling the entire printing apparatus. Motor driver 52 typically includes circuitry suitable for causing the motor 40 to start, stop, and rotate in a selected direction. If motor 40 is a DC motor, the direction of rotation is typically determined by the polarity of the inputs to the motor 40. A typical design of motor driver 52 will include an "H-drive" as known in the art, an arrangement of switches suitable for changing the output polarity of the driver 52 quickly. By controlling the rotational direction of motor 40, the direction of travel of shuttle 30, as shown in FIG. 2, is controlled.

Among the inputs to CPU 50 is the output of a "home sensor" 42, which can be seen in both FIGS. 2 and 3. Home sensor 42 is a mechanical, optical, or other sensors which outputs a predetermined signal when the shuttle 30 is of a predetermined spatial relationship thereto. Because of the placement of sensor 42 in FIG. 2, in this embodiment sensor 42 outputs a "home signal" when the shuttle 30 is close to motor 40, but in another design home sensor 42 could be disposed toward the end of lead screw 34. Typically, home sensor 42 should be near what is considered the "home position" of shuttle 30 when shuttle 30 is not in use.

Another input to CPU 50 is the output of an analog-digital converter (ADC) 54. ADC 54 is in turn associated with an output signal from motor driver 54. In one embodiment, the output signal from motor driver 54 is the sense current demand or consumption from motor 40, which is measured in real time. The real-time measured current demand is converted to a digital signal by ADC 54 and fed to CPU 50. CPU 50 may also maintain (internally or externally) a timer 56 for timing certain actions of motor 40, such as how long the motor 40 has been rotating in a certain direction, as will be described in detail below.

A control system for operating the apparatus such as shown in FIG. 2 must ensure that shuttle 30 originates at the home position such as at home sensor 40, travels to the end of lead screw 34, and then travels back to the home position, thus cleaning the entire effective length of a corona member in the charging device. The present embodiment provides a control system for ensuring this behavior using the above-described inputs to CPU 50. The output of CPU 50 is in effect an instruction to the motor driver 52 to rotate in one or another direction, or to stop rotating.

When a cleaning or wiping process is initiated, the shuttle 30 starts in a home position by home sensor 42 and the motor 40 is in effect instructed by CPU 50 to start rotating lead screw 34 in a rotational direction which will cause shuttle 30 to move away from the home position. The shuttle 30 then moves along lead screw 34 and the wipers 36, 38 thereon wipe the wires 22, 24 or other corona member, depending on a particular design. When the shuttle 30 reaches the end of the lead screw 34, the shuttle 30 is stopped from further movement, essentially by hitting a surface (not shown) on the inside of the printing apparatus. When the shuttle is restricted from further movement, in the case of motor 40 being a DC brush motor, the effect on the motor 40 will be an increase in power, and in the present case, current consumption by the motor 40. This increase in current consumption is detected by an input from motor driver 52 to ADC 54, which in turn converts the sense current from driver 52 to a digital signal which is recognized by CPU 50.

According to the present embodiment, a control system manifest in CPU 50 detects a current consumption by motor 40 which is above a predetermined threshold, and in response thereto, reverses the direction of rotation of motor 40, in effect reversing the direction of travel of shuttle 30 along lead screw 34, so that shuttle 30 returns to the home position. In effect, the detection of a high current consumption by motor 40 is used as a source of feedback to instruct the control system to bring the shuttle 30 back to the home position.

Figure 4:
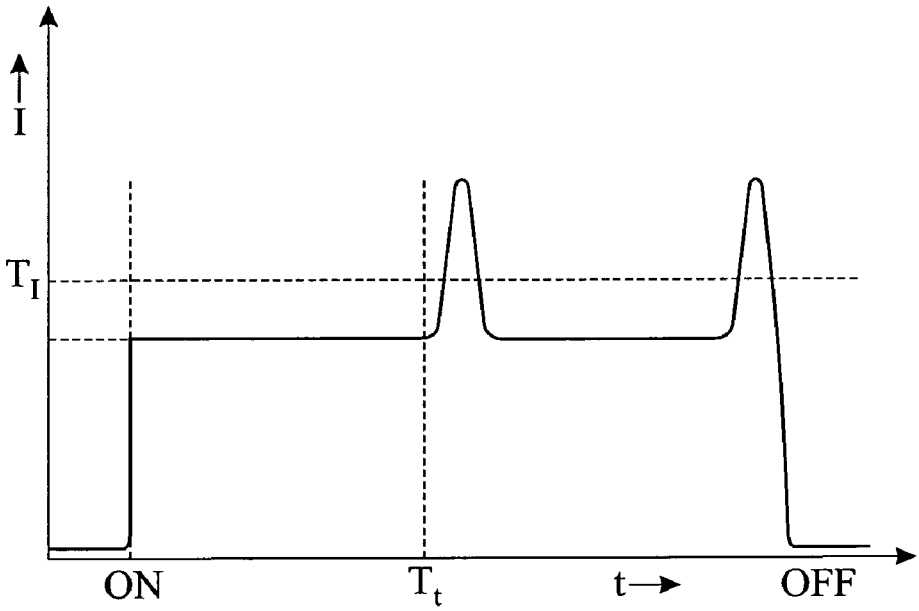
FIG. 4 is a graph of current consumption over time, illustrating a principle related to the control system of FIG. 3.

FIG. 4 is a graph of current consumption I of the motor 40 over time t, illustrating a principle related to the control system of FIG. 3. In the Figure, the initiation of the wiping process at ON is shown by the current consumption increasing from zero to a steady-state level. When the shuttle 30 hits the end of the lead screw 34, the current consumption I increases, and soon exceeds a predetermined threshold $T_I$ (or otherwise enters a predetermined range). When this predetermined threshold is exceeded, the CPU 50 is instructed, via ADC 54, to control driver 52 to change the rotational direction of motor 40. When the shuttle 30, on its return, hits another surface within the apparatus and is thus restricted from moving further, a second detected increase, as shown, can be detected and used by CPU 50 to stop further rotation of motor 40. Alternately, the rotation can be stopped in response to the shuttle in effect contacting (mechanically or optically) home sensor 42.

A possible fault condition within the above-described system is when the shuttle is mechanically stopped before a time consistent with the shuttle 30 having reached the end of the lead screw 34. In other words, if the shuttle 30 is blocked by something, such as debris or paper, along the lead screw and therefore starts consuming extra current, the current spike shown in FIG. 4 will occur too early. In order to detect such a fault, the control system in CPU 50 will indicate a fault (such as through a user interface, not shown) or otherwise react to the fault (such as by shutting down the apparatus) if an increase in current consumption occurs before a predetermined threshold time $T_t$. A similar threshold can be employed with respect to the return trip of shuttle 30. The timing of the motion of the motor 40 can be maintained by timer 56, or indirectly by counting a number of rotations of motor 40.

A practical advantage of the above-described system is that the motion of shuttle 30 can be monitored and controlled with a very small set of sensors, in one case purely by the feedback from motor driver 52. Ancillary sensors, such as for directly detecting whether the shuttle 30 is at an end of lead screw 34, are not required.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A printing apparatus, comprising:

an imaging surface;

a charging device for placing a charge on the imaging surface, the charging device including a corona member extending in an extension direction;

a shuttle movable along the extension direction, the shuttle including a cleaning member useful for cleaning the corona member;

a motor for moving the shuttle along the extension direction; and control means for changing a direction of the motor in response to detecting a power consumption of the motor within a predetermined range, the control means measuring a time between an initiation of the motor and a condition of power consumption of the motor relative to a predetermined range, and reacting to a fault condition if the measured time between the initiation of the motor and the condition of power consumption of the motor within a predetermined range is below a predetermined threshold.

2. The apparatus of claim 1, further comprising a converter for converting a rotational motion of the motor to linear motion.

3. The apparatus of claim 2, the converter including a lead screw.

4. The apparatus of claim 1, the corona member including at least one wire.

5. The apparatus of claim 1, the corona member including a screen.

6. The apparatus of claim 1, wherein the corona member is biased.

7. The apparatus of claim 1, the control means detecting an increase in power consumption of the motor.

8. The apparatus of claim 7, the control means detecting an increase in current consumption of the motor.

9. The apparatus of claim 1, the motor including a DC brush motor.

10. The apparatus of claim 1, the control means stopping the motor in response to detecting a second increase in power consumption of the motor.

11. The apparatus of claim 1, the charging device being one of a charge corotron, transfer corotron, and detack corotron.

* * * * *